US008191559B2

(12) United States Patent
Bickford

(10) Patent No.: US 8,191,559 B2
(45) Date of Patent: Jun. 5, 2012

(54) COMPRESSIBLE COSMETIC APPLICATOR

(75) Inventor: William Robert Bickford, Ronkonkoma, NY (US)

(73) Assignee: ELC Management LLC, New York, NY (US)

( * ) Notice: Subject to any disclaimer, the term of this patent is extended or adjusted under 35 U.S.C. 154(b) by 31 days.

(21) Appl. No.: 12/765,007

(22) Filed: Apr. 22, 2010

(65) Prior Publication Data

US 2011/0094534 A1 Apr. 28, 2011

Related U.S. Application Data

(60) Provisional application No. 61/179,277, filed on May 18, 2009.

(51) Int. Cl.
*A45D 40/26* (2006.01)
*A46B 11/00* (2006.01)

(52) U.S. Cl. ..... 132/218; 132/320; 401/126; 401/129

(58) Field of Classification Search ..... 132/212, 132/216–218, 313, 320; 401/126, 128, 129; 15/160, 187, 188, 236.03; 206/15.2, 15.3, 206/209, 209.1, 361, 362.2, 362.3; 604/1–3
See application file for complete search history.

(56) References Cited

U.S. PATENT DOCUMENTS

| | | | | |
|---|---|---|---|---|
| 702,359 | A | 6/1902 | Durston | |
| D238,212 | S | 12/1975 | Kingsford | |
| 3,998,235 | A | 12/1976 | Kingsford | |
| 4,446,880 | A * | 5/1984 | Gueret et al. | 132/218 |
| 4,545,393 | A | 10/1985 | Gueret et al. | |
| 4,600,328 | A | 7/1986 | Clements | |
| 4,869,612 | A | 9/1989 | Mooney et al. | |
| 5,052,839 | A | 10/1991 | Pettengill | |
| 5,123,431 | A * | 6/1992 | Wilson | 132/320 |
| D366,566 | S | 1/1996 | Denebeim | |
| 5,611,361 | A | 3/1997 | Leone | |
| 5,761,760 | A * | 6/1998 | Dumler et al. | 15/206 |
| 6,029,675 | A | 2/2000 | Dumler | |
| 6,033,143 | A * | 3/2000 | Gueret | 401/129 |
| 6,220,254 | B1 * | 4/2001 | Gueret | 132/313 |
| 6,655,390 | B2 * | 12/2003 | Gueret | 132/218 |
| 7,077,592 | B2 * | 7/2006 | Gueret | 401/128 |

(Continued)

FOREIGN PATENT DOCUMENTS

FR 2872999 * 7/2004

(Continued)

OTHER PUBLICATIONS

MatWeb Material Propert Data, Shore (Durometer) Hardness Testing of Plastics, http://www.matweb.com/reference/shore-hardness.aspx, Nov. 13, 2007, pp. 1-3.*

(Continued)

*Primary Examiner* — Todd Manahan
*Assistant Examiner* — Tatiana Nobrega
(74) *Attorney, Agent, or Firm* — Martin W. Haerter

(57) ABSTRACT

An applicator head for cosmetic products such as mascara is described. The applicator head has at least two arched supports, each with and outwardly directed applicator surface. The arched supports surround a clearance and define a relatively large, expanded configuration for loading and application purposes. The arched supports flex inwardly, into the clearance, so that the expanded configuration can collapse to permit the applicator head to be drawn through a relatively smaller wiper opening. The applicator head can be used in stock packaging.

1 Claim, 7 Drawing Sheets

U.S. PATENT DOCUMENTS

| | | | | |
|---|---|---|---|---|
| D568,614 | S | 5/2008 | Lou | |
| 7,467,905 | B2 | 12/2008 | Habatjou | |
| D591,955 | S | 5/2009 | Kulik | |
| D633,650 | S * | 3/2011 | Uehara et al. | D28/7 |
| D638,987 | S * | 5/2011 | Limongi et al. | D28/7 |
| D638,989 | S * | 5/2011 | Limongi et al. | D28/7 |
| D640,000 | S * | 6/2011 | Limongi | D28/7 |
| 2005/0137515 | A1* | 6/2005 | King | 604/1 |
| 2005/0217691 | A1 | 10/2005 | Petit | |
| 2005/0249539 | A1* | 11/2005 | Habatjou | 401/127 |
| 2005/0271454 | A1* | 12/2005 | Gueret | 401/129 |
| 2006/0002758 | A1* | 1/2006 | Gueret | 401/129 |
| 2006/0279181 | A1* | 12/2006 | Gueret | 312/218 |
| 2007/0017544 | A1* | 1/2007 | Gueret | 132/320 |
| 2007/0020027 | A1* | 1/2007 | Gueret | 401/130 |
| 2007/0246058 | A1 | 10/2007 | Bodelin | |
| 2008/0060669 | A1 | 3/2008 | Malvar et al. | |
| 2008/0202546 | A1 | 8/2008 | Keurinck | |
| 2009/0065018 | A1* | 3/2009 | Berhault | 132/218 |
| 2009/0065020 | A1 | 3/2009 | Butcher et al. | |
| 2009/0133707 | A1* | 5/2009 | Gueret | 132/200 |
| 2010/0129134 | A1* | 5/2010 | Gueret | 401/122 |
| 2011/0030718 | A1* | 2/2011 | Gueret | 132/218 |
| 2011/0222955 | A1* | 9/2011 | Thorpe | 401/122 |

FOREIGN PATENT DOCUMENTS

| | | | |
|---|---|---|---|
| FR | 2782999 | * | 1/2006 |

OTHER PUBLICATIONS

MatWeb Material Property Data, Property Search Elastomer TPE shore hardness 62-70 Shore D, http://www.matweb.com/search/PropetrtySearch.aspx, pp. 1-8.*

MatWeb Material Property Data, Property Search Elastomer TPE shore hardness 40-100 Shore D, http://www.matweb.com/search/PropetrtySearch.aspx (40-100 Shore D), Oct. 5, 2011, pp. 1-3.*

PCT International Search Report; International Application No. PCT/US2010/031966; Completion Date: Dec. 28, 2010; Date of Mailing: Dec. 29, 2010.

PCT Written Opinion of the International Searching Authority, or the Declaration; International Application No. PCT/US2010/031966; Completion Date: Dec. 28, 2010; Date of Mailing: Dec. 29, 2010.

* cited by examiner

COMPRESSIBLE COSMETIC APPLICATOR

CROSS-REFERENCE TO RELATED APPLICATIONS

The present application claims priority from U.S. Provisional Application No. 61/179,277, filed May 18, 2009.

FIELD OF THE INVENTION

The present invention is in the field of cosmetic packaging that includes an applicator wand. More particularly, the invention is an applicator head portion for attaching to an applicator wand for use with cosmetics such as mascara.

BACKGROUND OF THE INVENTION

For the convenience of the cosmetic user, cosmetic packaging often includes a cosmetic applicator suitable for dispensing the particular cosmetic contained in the package reservoir or vial. Mascara packaging, for example, usually includes an applicator wand that extends into a tubular vial. Cosmetic applicator wands generally comprise a handle portion, a rod extending from the handle portion to an application end and an applicator head separately attached to or integrally molded with the application end of the rod. The handle portion doubles as a closure cap for the cosmetic product reservoir or vial. The rod extends the reach of the wand into the product reservoir for retrieving product from the vial. The applicator head is loaded with product from the reservoir, transports the product to the application area (e.g., eyelashes) and delivers the product to the application area. The applicator head may additionally be used to 'dress' the applied product, e.g., spread, thin or thicken the application, separate lashes, etc. Applicator head configurations are determined by a number of factors including the ergonomics of the treatment area on the user, desired application characteristics and dimensions of the packaging from which a cosmetic product is drawn. For example, conventional or 'stock' mascara applicator heads comprising a twisted wire core brush with bristles extending from the core have a generally elongated cylindrical bristle envelope (as defined by the bristle tips), though the cylindrical envelope is often tapered for example at one or both ends. Corresponding conventional or 'stock' containers have a generally elongate vial for storing mascara product with a wiper in the neck of the vial through which the applicator head is drawn to control the dose of product loaded on the brush. Conventional brushes, vials and wipers are available in a relatively small number of stock sizes. Molded applicator heads having a variety of shapes and configurations are also known, a number of which have a core with bristle-like tines extending to form an elongated cylindrical envelope in dimensions and overall configuration that is similar to the more conventional twisted wire core brushes. Due to the similarity in dimensions and overall configuration, these molded applicators can be readily used in conventional packaging having stock vial and wiper dimensions. This significantly reduces production costs by avoiding the necessity for custom tooling and dies for vials and wipers with non-conventional dimensions.

However, there is a recent trend in the use of molded applicator heads that have non-conventional dimensions and/or shapes (e.g., spherical—see for example U.S. Publ. No. 2008/0202546 A1). Applicator heads with non-conventional dimensions and shapes are said to advantageously, for example, enhance 'volumizing' while avoiding 'clumping'. However, the non-conventional dimensions and shapes prevent these applicator heads from being used practically speaking with conventional or stock vials and wipers. For example, the non-conventional dimensions or shapes are either too large to fit through a stock wiper, or are too oddly shaped to be wiped effectively by a stock wiper resulting in messy and/or unpredictable wiping characteristics. Additionally, applicator heads with non-conventional dimensions or shapes may require that other parts of the package be customized to accommodate the larger dimensions or shapes, e.g., rods, wipers and vials may need to be enlarged. These custom package pieces may become unwieldy and unattractive. Also, applicator heads with non-conventional dimensions or shapes may require additional custom tooling and dies to produce not only the applicator head, but corresponding wipers, vials, rods and caps dimensioned to accommodate the non-conventional applicator heads.

U.S. Pat. Nos. 4,446,880 and 4,545,393 to Gueret and 7,467,905 to Habatjou disclose make-up brushes/applicators that are variable in diameter by varying the length in response to manipulation of actuation means or an adjuster element. In order to achieve an expanded configuration, the actuation means/adjuster element must be manipulated—and inconvenience for the user. Furthermore, there is no indication that the brush or applicator in an expanded configuration is capable of being drawn through a relatively smaller wiper opening. The '880 and '393 disclosures clearly indicate that the bellows embodiment has sufficient elasticity to cause it to resume the elongated reduced diameter portion, i.e., the brush is biased to the smaller configuration rather than the expanded configuration of the present invention. The '905 disclosure appears to be similar. The disclosed brushes are also relatively complex in both construction (numerous parts to be assembled) and use (manipulation of the actuation means or adjuster element to achieve an expanded configuration).

U.S. Pat. No. 4,869,612 to Mooney discloses a similarly complex liquid applicator in which pads on supports are urged away from a central shaft by shortening the shaft to arching the supports into an expanded configuration in spring compression. This is contrary to the present invention where the static state of the curved supports is the expanded position, i.e., there is no spring compression in the expanded configuration.

None of the foregoing prior art references disclose an applicator that is biased to a substantially enlarged configuration, but readily collapses to facilitate withdrawal through a relatively small wiper opening.

Accordingly there is a need for a simplified and cost effective applicator head for cosmetic products such as mascara wherein the applicator head automatically expands to larger than conventional dimensions or shapes, but can be used in a conventionally dimensioned and shaped packaging, i.e., a stock vial and wiper.

SUMMARY OF THE INVENTION

The present invention is an applicator head for cosmetic products such as mascara wherein the applicator head exhibits non-conventional dimensions or shapes, but can be used in a conventionally dimensioned and shaped packaging, i.e., a stock vial and wiper. The present invention solves the need exhibited by the prior art by providing a relatively large cosmetic applicator head for application purposes, but the applicator head collapses sufficiently to be used in a stock vial and drawn through a stock wiper system. The applicator head comprises a base adapted to be connected to an applicator rod which is in turn connected to handle portion in the form of a cap/closure for a product vial. A central longitudinal axis is defined through the base. At lease two arched supports extend from the base along the longitudinal axis. Each support extends from a proximal end that is connected to the base to a distal end. Each of the two arched supports has an outwardly directed surface adapted to convey and apply cosmetic product, e.g., mascara. The two supports are outwardly biased to define and maintain a clearance about the longitudinal axis. The two supports are adapted to flex into the clearance when the applicator head is drawn through the first dimension of the wiper opening. The resulting applicator head has a relatively large, circle-like or heart-shaped application configuration that exhibits the benefits of a non-conventional applicator head, but that collapses to a configuration and dimension suitable for use in a conventional, stock vial and wiper system.

The outwardly directed surface of each support is adapted to convey and apply cosmetic by being provided with projections, tines, bristles, ribs, grooves or other surface features that are suitable for loading, transporting and applying cosmetic product such as mascara.

Another embodiment of the applicator head has plurality of arched supports extending from the base along the longitudinal axis. Each support extends from a proximal end connected to the applicator head base to a distal end. Each of the plurality of arched supports has an outwardly directed surface adapted to convey and apply cosmetic product. Each of the plurality of supports is outwardly biased to define and maintain a clearance about the longitudinal axis. Each of the plurality of supports is adapted to flex into the clearance when the applicator head is drawn through the stock wiper opening.

DETAILED DESCRIPTION OF THE INVENTION

Figure 1:
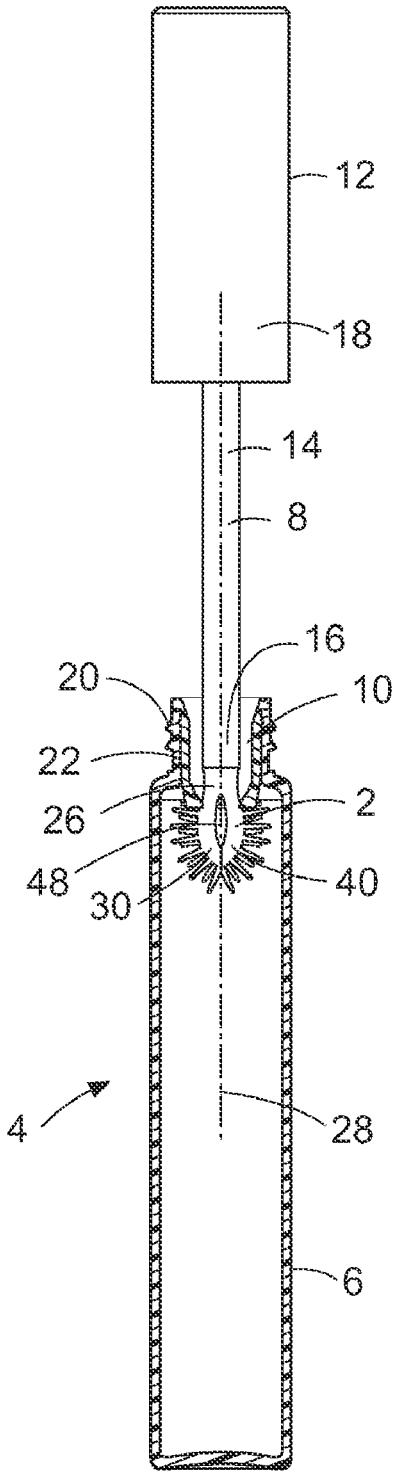
FIG. 1 shows an applicator wand including the applicator head of the present invention in elevation view inserted in a vial and wiper shown in cross-section, with the applicator head partially compressed as it begins to pass through the wiper.
Figure 2:
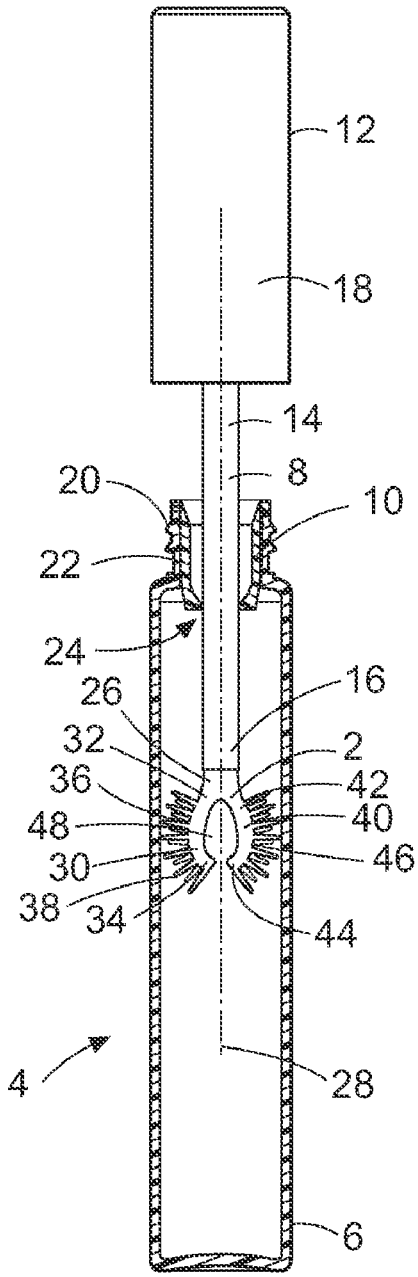
FIG. 2 shows the applicator wand of FIG. 1 including the applicator head of the present invention in elevation view inserted in a vial and wiper shown in cross-section, with the applicator head fully expanded within the vial.
Figure 3:
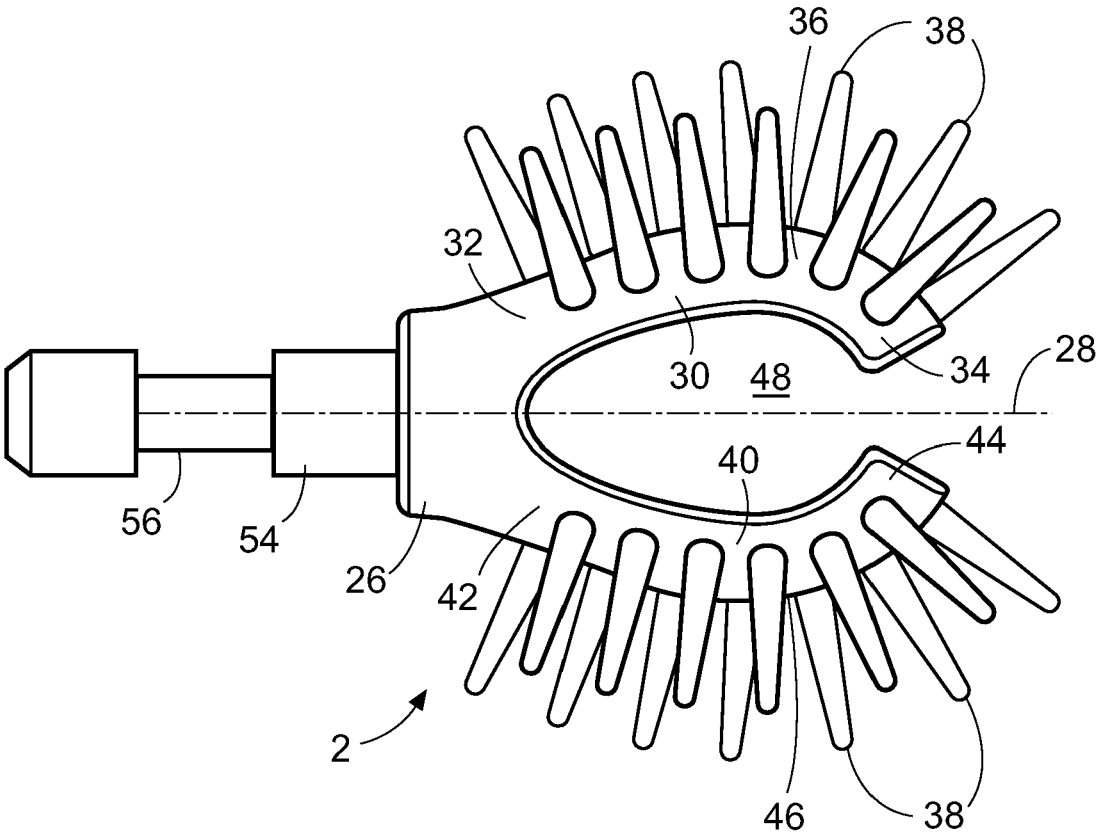
FIG. 3 is an elevation view of the applicator head illustrated in FIGS. 1 and 2, removed from the application wand.

A compressible mascara applicator head according to the invention is shown in FIGS. 1, 2 and 3 at reference number 2. The applicator head has relatively larger than conventional dimensions preferred for loading and application purposes, but collapses or compresses substantially when drawn through a conventional wiper.

The applicator head 2 is shown in a preferred embodiment in its environment, a cosmetic package system 4 including a vial 6, an applicator wand 8 and a wiper 10. The wand 8 includes a handle portion 12, a rod 14 attached to and extending from the handle portion to an application end 16 and the applicator head 2 extending from the application end 16 of the rod 14. The handle portion 12 doubles as a closure cap 18 for the vial 6. The cap is provided with internal threads (not shown) suitable for cooperative engagement with external threads 20 on a neck 22 of the vial 6 to effect a secure closure. Note that in FIGS. 1 and 2, the applicator wand 8 including the handle portion 12, rod 14 and applicator head 2 are illustrated in elevation view, while the vial 6 including the wiper 10 are illustrated in cross-sectional view.

The wiper 10 defines a wiper opening 24 with a first dimension (FIG. 2). The dimension of the wiper opening 24 may be substantially the same as the diameter of the rod 14, so that the rod 14 closely occupies the wiper opening 24 as illustrated. However, the rod may also be a suitable smaller diameter. The diameter of the rod corresponding diameter of the wiper opening 24 can be in the conventional range of about 0.1 inches to 0.4 inches.

Referring now to FIG. 3, the applicator head 2 comprises a base 26 adapted to be connected to and extend from the application end 16 of the rod 14 (shown in FIGS. 1 and 2). The applicator head 2 may be separately attached to or integrally molded with the application end 16 of the rod 14. When it is separately attached, the base 26 is connected to the application end 16 of the rod 14 by conventional means. For example, the base 26 may include a mounting post or lug 54 (FIG. 3) extending from the base 26. The post 54 is dimensioned to be received in a bore (not shown) in the application end 16 of the rod 14. The mounting post 54 may include a reduced diameter portion 56 to facilitate 'staking' of the rod 14 to the post 54. Alternatively, the post 54 may be secured to the rod 14 by any conventional means for securing a molded applicator head to an applicator wand such as, for example, heat staking, press fit, snap fit, pinning, adhering, bonding or welding. The post 54 may have grooves, flutes, annual rings or cuts, or any other structural details to improve the fastening ability to the rod 14. A central longitudinal axis 28 is defined through the base 26. An arched first support 30 extends along and spaced from the longitudinal axis 28 from a first proximal end 32 connected to the base 26 to a first distal end 34. The first support 30 has a first outwardly directed applicator surface 36 adapted to convey and apply cosmetic product such as, for example, mascara. An arched second support 40 extends along and spaced apart from the longitudinal axis 28 generally opposite the first support 30. The second support 40 extends from a second proximal end 42 connected to the base 26 to a second distal end 44. The second support 40 has a second outwardly directed applicator surface 46 adapted to convey and apply mascara product.

Figure 7:
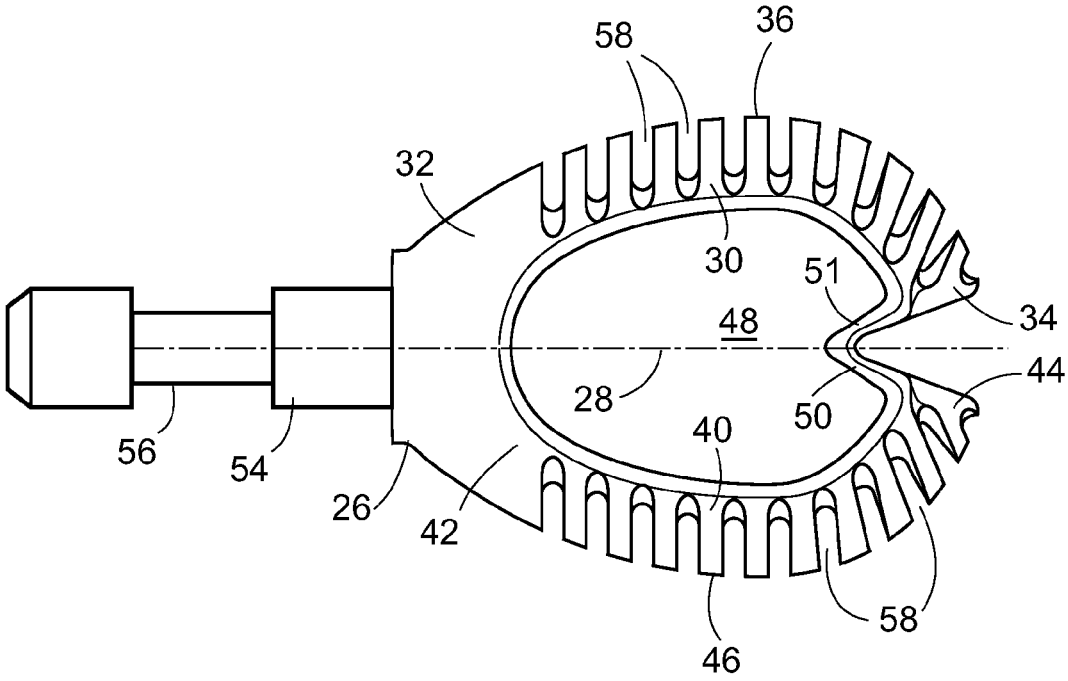
FIG. 7 is an elevation view of yet another embodiment of the applicator head of the invention wherein the outwardly directed applicator surfaces 36, 46 are adapted with clearances in the form of grooves or cuts.

As illustrated, tines 38 may be provided that project out from the outwardly directed applicator surfaces 36, 46 to facilitate the loading, conveyance, application and doctoring of cosmetic product. Alternatively, the outwardly directed surfaces 36, 46 of each of the first and second support, 30 and 40 respectively, may be adapted to convey and apply cosmetic by being provided with other types of projections, bristles, tines, flocking, particles, ribs, grooves, discs, slits, cuts, holes, dimples, foam or other surface features or surface treatments (e.g., abrading) that are suitable for loading, transporting and applying cosmetic product such as, for example, mascara. For example, as shown in FIG. 7, the outwardly directed applicator surfaces 36, 46, may be provided with recesses in the form of grooves or cuts 58 suitable for loading, transporting and applying cosmetic product such as mascara. Additionally, the adaptations provided to each of the outwardly directed surfaces 36, 46 may differ to facilitate different functions. For example, surface 36 may be proved with broader tines better suited for loading and application of mascara to lashes, while surface 46 may be provided with thinner tines better suited for doctoring of applied mascara, or shaping and separation of lashes.

At least one of the first support 30 and the second support 40 is outwardly biased from the longitudinal axis 28 to define an expanded configuration for the applicator head as illustrated in FIGS. 2 and 3. Preferably, both the first support 30 and the second support 40 are outwardly biased to provide the expanded configuration. The expanded configuration created by the outwardly biased first and/or second supports 30, 40 defines a relatively larger clearance 48 about the longitudinal axis 28 between the first support 30 and the second support 40 (see FIGS. 2 and 3). For an applicator head intended for application of mascara, for example, the dimension of the expanded configuration taken as the greatest distance between outwardly directed application surfaces 36 and 46 would ideally be in the range of about 0.125 inches to about 0.8 inches. In the expanded configuration with relatively larger clearance 48, the applicator head 2 is substantially larger than the first dimension of the wiper opening 24 (see FIG. 2). To permit the relatively larger applicator head 2 to pass through the relatively smaller wiper opening 24 in either direction at least one of the first support 30 and the second support 40 is adapted to flex into the clearance 48 to define a compressed configuration (see FIG. 1). In the compressed configuration, the clearance 48 is substantially reduced in size. The compressed configuration defined by the ability of the flexing of the support or supports permits the applicator head to be pushed into or drawn out through the relatively smaller dimension of the wiper opening 24. Preferably, both the first support 30 and the second support 40 flex into the clearance 48 when the applicator head is drawn through the wiper opening 24 as shown in FIG. 1. To facilitate flexing of the first and/or second support 30, 40, the entire length of each support may be flexible, or a portion of each support may be thinned or coined or otherwise worked to soften the material, e.g., the proximal end 32, 42, of one or each support may be weakened to promote flexing into the clearance 48. After the applicator head 2 has passed through the wiper opening 24 in either direction, i.e., either inside the vial or outside the vial, the applicator head 2 returns fully to the expanded configuration shown in FIGS. 2 and 3. The arched configuration of the first support 30 and second support 40 facilitate entry of the applicator head 2 into the relatively narrow wiper dimensions from inside the vial 6 as the wand is withdrawn from the vial 6, as well as from outside the vial 6 as the applicator head 2 is returned into the vial 6.

Figure 6A:
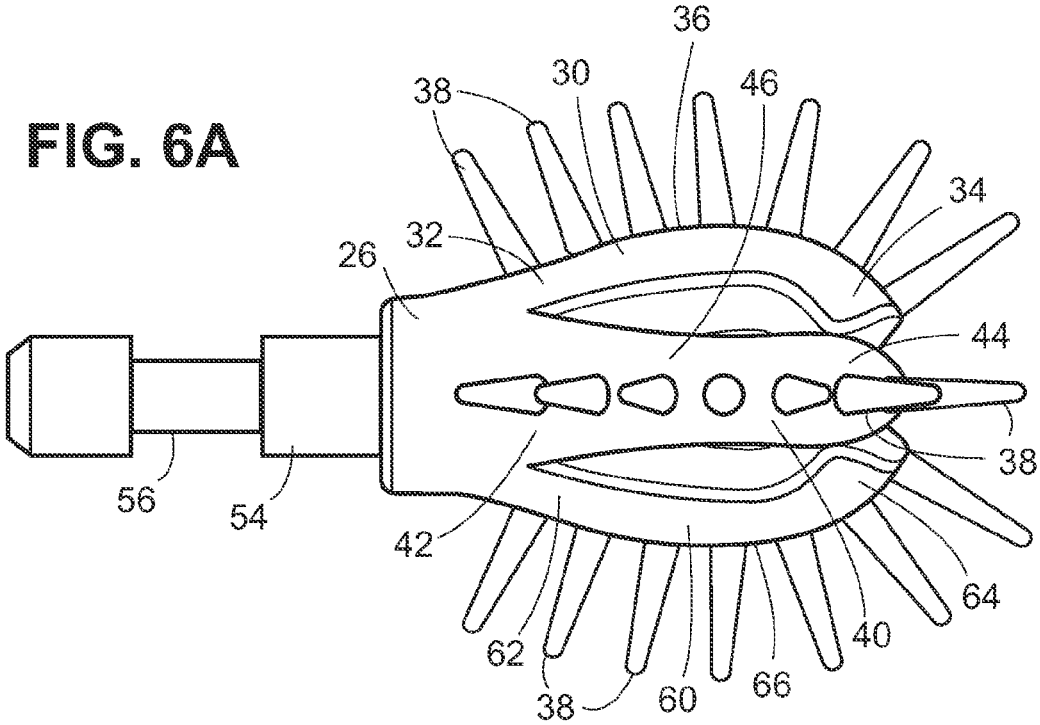
FIG. 6A is an elevation view and FIG. 6B is a perspective view of yet another embodiment of the compressible mascara applicator head of the present invention wherein a plurality of arched supports are provided, e.g., three or more supports.
Figure 6B:
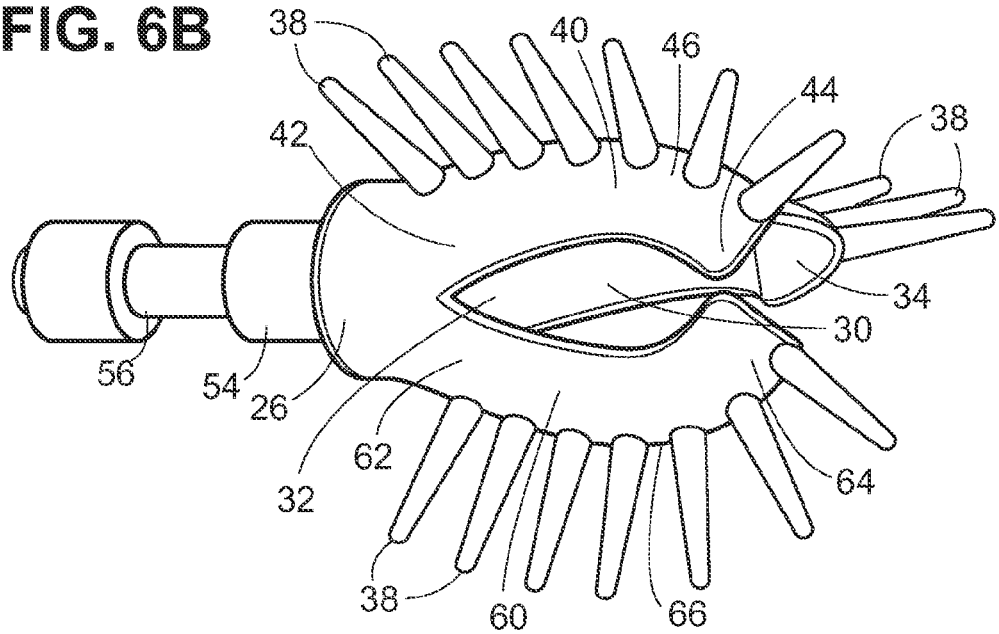

Although illustrated in FIGS. 1, 2 and 3 with a first support 36 and second support 46, the compressible mascara applicator of the present invention may further comprise a plurality of arched supports, e.g., three or more supports, as illustrated, for example, in FIGS. 6A and 6B. Referring to FIGS. 6A and 6B, an arched first support 30 extends along and spaced from the longitudinal axis 28 from a first proximal end 32 connected to the base 26 to a first distal end 34. The first support 30 has a first outwardly directed applicator surface 36 adapted to convey and apply cosmetic product such as, for example, mascara. An arched second support 40 extends along and spaced apart from the longitudinal axis 28 approximately opposite the first support 30. The second support 40 extends from a second proximal end 42 connected to the base 26 to a second distal end 44. The second support 40 has a second outwardly directed applicator surface 46 adapted to convey and apply mascara product. An arched third support 60 extends along and spaced apart from the longitudinal axis 28 approximately opposite and equally spaced from the first support 30 and second support 40. The third support 60 extends from a third proximal end 62 connected to the base 26 to a third distal end 64. The third support 60 has an outwardly directed applicator surface 66 adapted to convey and apply mascara product. The arched supports 30, 40 and 60 may be provided with tines 38. While shown with three arched supports, the applicator head may have any suitable number of arched supports, each with an outwardly directed application surface adapted to convey and apply cosmetic product such as, for example, mascara, with, for example, tines or other surface structure. One or more of the plurality of arched supports 30, 40, 60 are outwardly biased from the longitudinal axis 28 to define an expanded configuration including a clearance 48 for the applicator head (see FIGS. 6A and 6B). One or more of the plurality of arched supports 30, 40, 60 are also adapted to flex into the clearance 48 to define a compressed configuration as described above with respect to the two arched support embodiment, i.e., sufficiently small enough to permit the applicator head to pass through the wiper opening. Once through the opening in either direction, i.e., inside the vial or outside the vial, the applicator head returns fully to the expanded configuration shown in FIGS. 6A and 6B.

Figure 4:
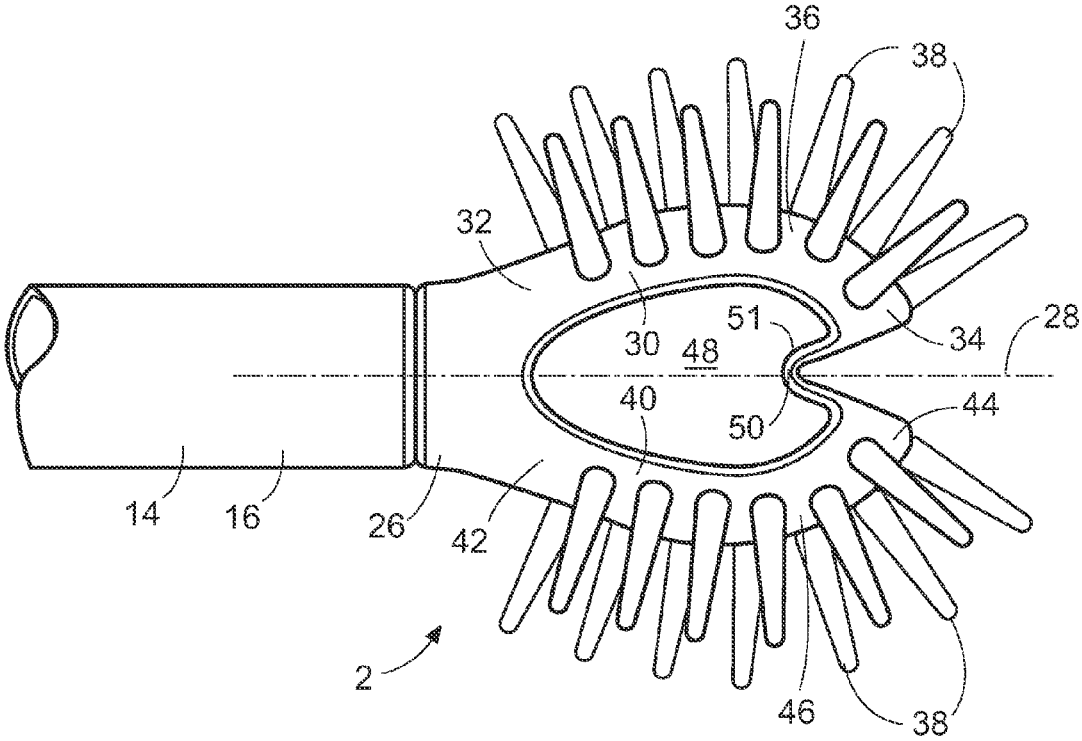
FIG. 4 is an elevation view of another embodiment of the applicator head of the invention including a hinge connecting the distal ends of the arched supports.
Figure 8:
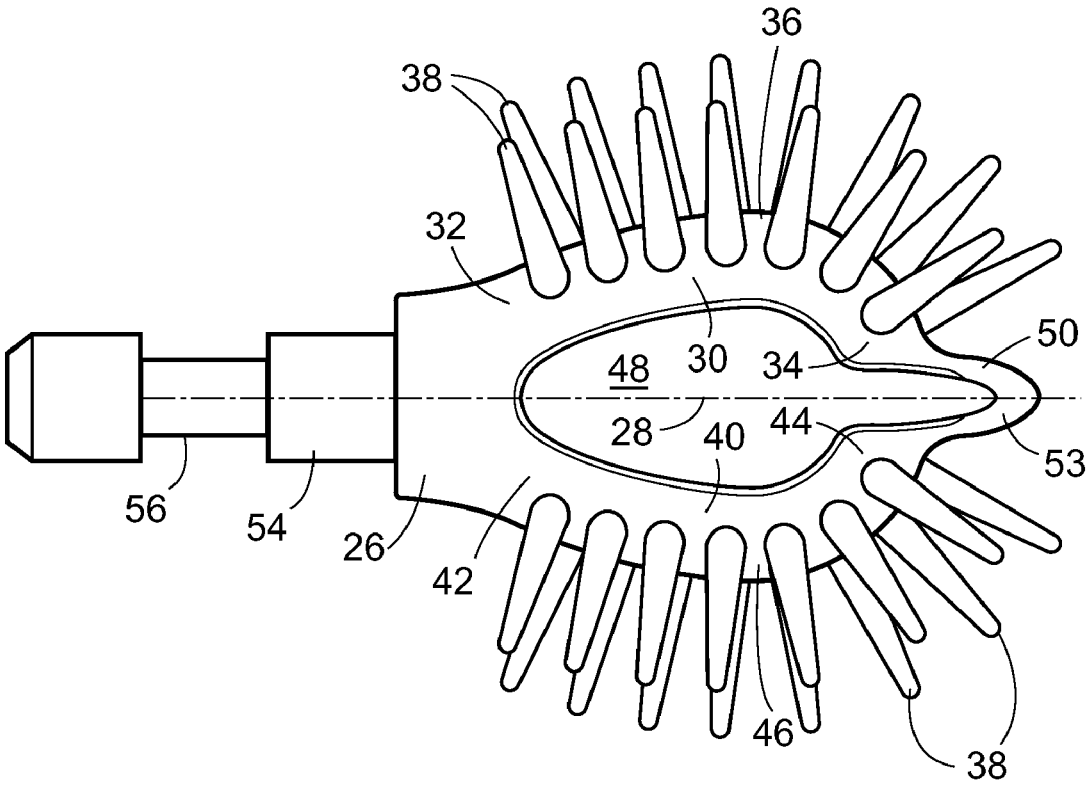
FIG. 8 is an elevation view of yet another embodiment of the applicator of the invention wherein the hinge is in the form of an outwardly directed web.

The first support 30 and second support 40 may be connected by a hinge 50 in the form of an inwardly directed flexible web 51 connecting the first distal 34 end and the second distal end 44 (FIGS. 4, 7). Alternatively, the hinge 50 may take the form of an outwardly directed flexible web 53 (FIG. 8) that is shaped to guide the applicator head 2 into the wiper opening 24 when the wand 8 is returned to the vial 6. The hinge 50 stabilizes the position of the first distal end 34 of the first support 30 relative to the second distal end 44 of the second support 40 as the applicator head 2 is pulled or pushed through the wiper opening. Additionally, as the hinge 50 pinches closed when the applicator head 2 is drawn through the wiper opening 24, excess mascara that might otherwise remain on the first and second distal end 34, 44, respectively, of each support is squeezed out of the hinge 50 and removed by the wiper 10. Thus, the hinge 50 avoids the excess cosmetic build-up that is typically found on the free end of conventional applicators.

Figure 5:
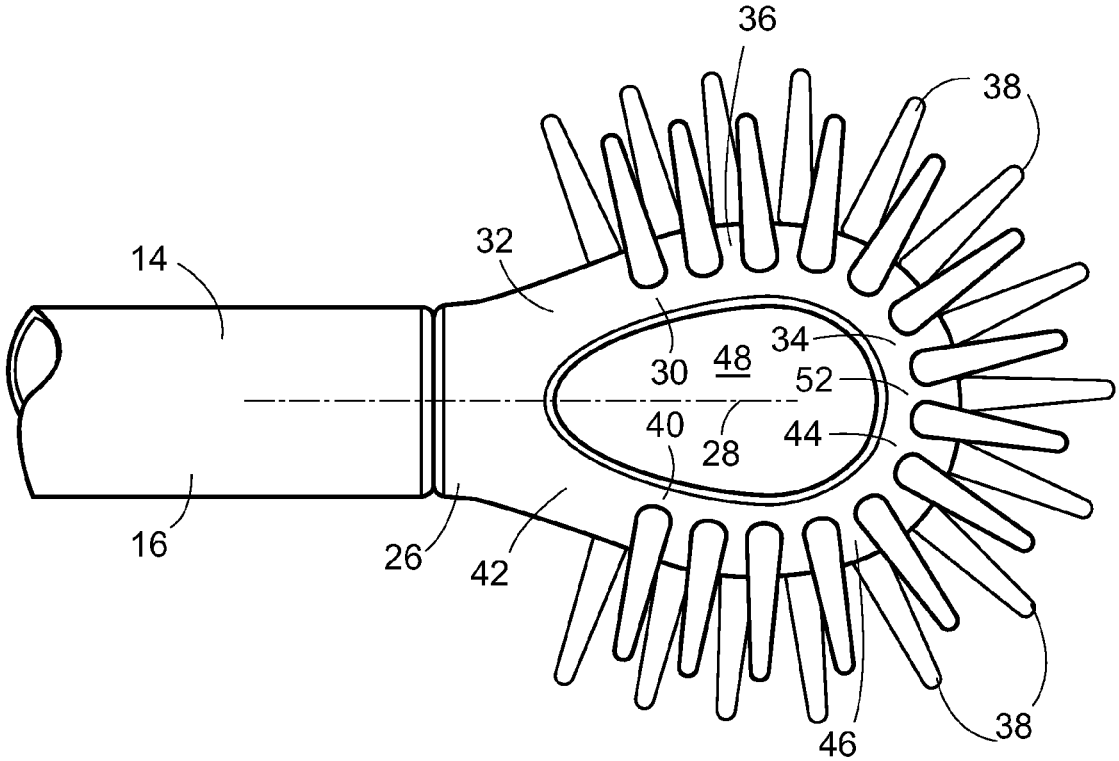
FIG. 5 is an elevation view of yet another embodiment of the applicator head of the invention wherein the distal ends of the arched supports are directly connected with no intervening structure.

Optionally, the first distal end 34 of the first support 30 may be connected more directly to the second distal end 44 of the second support 40 as shown in FIG. 5 at reference number 52, i.e., without an intervening structure. The direct connection would be adapted by selection of material and/or structure to provide sufficient flexibility of one or both supports 30, 40 to permit them to flex into the clearance 48 to facilitate passage through the wiper opening. This arrangement is believed to have the advantage of providing a greater propensity for the applicator head to return to the first expanded configuration from the compressed configuration after passing through the wiper opening for optimal performance.

The compressible mascara applicator head 2 can be made from any suitable material by molding, machining or other known processes. Suitable materials include, but are not limited to, polymer or rubber, including thermoplastic polymers and elastomers, fabric, non-wovens and meshes. Suitable materials would have sufficient outward bias to return to the expanded configuration and sufficient inward flexibility to be drawn through a relatively smaller wiper opening for multiple cycles typical during the useful life of a cosmetic package. A preferred material is Hytrel, a thermoplastic polyester elastomer made by DuPont. Preferably, the applicator head is made from a thermoplastic polyester elastomer. The entire applicator head 2 may be made from a single material, or various parts of the head may be made from different materials, i.e., at least one of the base 26, the first support 30 and the second support 40 may be made from a thermoplastic polyester elastomer, while other parts are made from another type of plastic. The applicator head 2 can be molded as a unitary piece, or in parts. The various parts can be molded together, as for example, by bi-injection, sequential injection, multiple-injection or over-molding one or more materials over a base material. Alternatively, the applicator head 2 may be assembled from parts by bonding, welding etc. Preferably, the entire applicator head 2, or at least one of the base 26, the first support 30 and the second support 40 are made of a material having a durometer in the range of 40-100 Shore D, and more particularly a material having a durometer in the range of 62-70 Shore D.

While the hollow heart-shaped configuration illustrated is a preferred embodiment, other configurations are contemplated, such as, for example, a "U" or "V" shape, hollow polygon, hollow clover shape, ellipse (similar to FIG. 5), etc.

In addition to the foregoing, due to its bias to the larger, expanded configuration, the applicator head has the added advantage of being capable of retrieving product from the walls of the vial (see FIG. 2) that might otherwise be unavailable to an applicator head with conventional dimensions, e.g., a conventional twisted wire brush.

While the invention has been primarily described in the context of an applicator for a mascara product, the applicator head of the present invention could be used for the application of any cosmetic product that would benefit from the use of a broad, enlarged applicator head configuration and that can be drawn through a conventional wiper, e.g., a lip gloss, an eye shadow, a foundation or a facial or skin treatment product.

What is claimed is:

1. A compressible mascara applicator head for use in a package including a wiper defining a wiper opening with a first dimension, the applicator head comprising:

a base adapted to be connected to an applicator rod, a central longitudinal axis defined through the base;

an arched first support extending along the longitudinal axis from a first proximal end connected to the base to a first distal end, the first support having a first outwardly directed applicator surface adapted to convey and apply mascara product;

an arched second support extending along the longitudinal axis generally opposite the first support, the second support extending from a second proximal end connected to the base to a second distal end, the second support having a second outwardly directed applicator surface adapted to convey and apply mascara product; and a hinge in the form of a flexible web connecting the first distal end and the second distal end, wherein the hinge comprises an inwardly directed web; and wherein the first support is outwardly biased from the longitudinal axis to define an expanded configuration with a second dimension greater than the first dimension of the wiper opening, the expanded configuration including a clearance about the longitudinal axis between the first support and the second support, and the first support is adapted to flex into the clearance when the applicator head is drawn through the first dimension of the wiper opening.

* * * * *